US006607468B1

(12) United States Patent
Nichols, Jr. et al.

(10) Patent No.: US 6,607,468 B1
(45) Date of Patent: Aug. 19, 2003

(54) TRAMPOLINE ENCLOSURE SYSTEM

(76) Inventors: Albert G. Nichols, Jr., 7251 Lane Park, Dallas, TX (US) 75225; David B. Nichols, 10537 Marquis, Dallas, TX (US) 75229; Jeffrey E. Kollmeier, 3509 Willowridge Dr., Arlington, TX (US) 76017

( * ) Notice: Subject to any disclaimer, the term of this patent is extended or adjusted under 35 U.S.C. 154(b) by 0 days.

(21) Appl. No.: 09/359,342

(22) Filed: Jul. 21, 1999

(51) Int. Cl.[7] ..... A63B 5/11
(52) U.S. Cl. ..... 482/27; 482/28; 482/35
(58) Field of Search ..... 482/27, 28, 35

(56) References Cited

U.S. PATENT DOCUMENTS

| | | | | |
|---|---|---|---|---|
| 2,991,841 A | * | 7/1961 | Sampson et al. | 482/27 |
| 3,201,126 A | | 8/1965 | Nissen | 273/95 |
| 3,339,925 A | | 9/1967 | Nissen | 273/95 |
| 3,837,643 A | | 9/1974 | Lee | |

(List continued on next page.)

FOREIGN PATENT DOCUMENTS

| | | | |
|---|---|---|---|
| AU | 256293 | 2/1964 | |
| FR | 2 623 719 | 6/1989 | |
| JP | 8 47550 | 8/1994 | 5/11 |
| JP | 9/084896 | 3/1997 | |
| WO | WO 98/58706 | 12/1998 | |

OTHER PUBLICATIONS

"Declaration of William H. Curtis", executed on Aug. 28, 2002, (11 pgs.).

Hedstrom, *Indoor/Outdoor Ball Pits* ® 1995, brochure (6 pgs.).

Hedstrom, *Trampoline Ball Pit* ®, Instruction Manual for Model No. 8–548, Version 1.3, Dec. 4, 1996, (8 pgs.).

Hedstrom, *Tramp Pit B/C, Single Zipper Access Zipper Closes Down*, May 19, 1995, (2 pgs.).

Hedstrom, *Hex Ball Pit*, Drawing, Oct. 25, 1993, (1 pg.).

Hedstrom, *Ball Pit*, Drawings, Jun., 1995 (5 pgs.).

The Fallguard Safety System, www.fallguard.net, Copyright 1998, (2 pgs.).

"The Original Fall–Guard Trampoline Safety Enclosure", http://123easy.com/adexersize/firsttry.htm, printed, on information and belief, on Jul. 23, 1998, (4 pgs.).

Gordon's Aeroball ™, Copyright 1982 D.W. Gordon, Inc., Color Photos, (7 pgs.).

"Declaration of Rolland Wayne Rich", executed on Feb. 25, 2002, (7 pgs.).

*Primary Examiner*—Jerome Donnelly
(74) *Attorney, Agent, or Firm*—Workman, Nydegger & Seeley

(57) ABSTRACT

A trampoline system includes a frame comprising a border rail encircling an opening and a plurality of support legs projecting from the frame. A trampoline bed is disposed within the opening and is secured to the border rail by a plurality of springs. The trampoline bed has a perimeter edge that is inwardly spaced apart from the border rail. A plurality of poles each upwardly project from the frame at spaced apart locations around the border rail. One or more tubular cushions encircle each of the poles. A flexible enclosure wall vertically upwardly extends above the trampoline bed so as to encircle the trampoline bed at the perimeter edge thereof. A plurality of elongated elastomeric ties extend from each pole to the enclosure wall so as to tightly support the enclosure wall in the vertical orientation. Stitching is used to secure the bottom edge of the enclosure wall adjacent to the perimeter edge of the trampoline bed.

19 Claims, 4 Drawing Sheets

U.S. PATENT DOCUMENTS

| | | | | | |
|---|---|---|---|---|---|
| 4,077,623 | A | | 3/1978 | Clausell | 272/61 |
| 4,284,271 | A | | 8/1981 | Pettit et al. | 272/70 |
| 4,380,327 | A | | 4/1983 | Fish | |
| 4,413,361 | A | | 11/1983 | Wolf et al. | |
| 4,433,838 | A | | 2/1984 | Gordon | 272/65 |
| 4,478,420 | A | | 10/1984 | Sowards | |
| 4,569,515 | A | | 2/1986 | Gordon | 272/65 |
| 4,598,905 | A | | 7/1986 | Vrana | |
| 4,644,892 | A | | 2/1987 | Fisher | |
| 4,776,581 | A | | 10/1988 | Shepherdson | |
| 4,836,530 | A | | 6/1989 | Stanley, Jr. | |
| 4,900,011 | A | | 2/1990 | Nolet | 272/65 |
| 5,010,603 | A | | 4/1991 | Hertzog | |
| 5,063,876 | A | | 11/1991 | Harris | |
| 5,102,103 | A | | 4/1992 | Putnam | |
| 5,299,781 | A | | 4/1994 | Barrett et al. | |
| 5,390,913 | A | | 2/1995 | Kepler | |
| 5,395,105 | A | | 3/1995 | Thommen, Jr. | |
| 5,399,132 | A | | 3/1995 | Bailey | 482/29 |
| 5,545,110 | A | | 8/1996 | Hsiang | 482/27 |
| 5,575,738 | A | | 11/1996 | Millington et al. | |
| 5,624,122 | A | | 4/1997 | Winkelhorn | 473/471 |
| D382,618 | S | | 8/1997 | Gift | |
| 5,664,769 | A | | 9/1997 | Sadinsky et al. | |
| 5,711,743 | A | | 1/1998 | Nichols, Jr. et al. | |
| 5,711,749 | A | | 1/1998 | Nichols, Jr. et al. | 482/27 |
| 6,053,845 | A | * | 4/2000 | Publicover | 482/27 |

* cited by examiner

TRAMPOLINE ENCLOSURE SYSTEM

BACKGROUND OF THE INVENTION

1. The Field of the Invention

The present invention relates to trampolines and, more specifically, enclosure systems operable with trampolines.

2. Present State of the Art

Trampolines are used extensively for both recreation and exercise. A conventional trampoline includes a flexible bed which is encircled and supported off the ground by a substantially rigid frame. A number of springs extend between the frame and the bed such that the bed produces a bouncing effect when an individual jumps thereon. Although trampolines have historically been used for simply jumping thereon, trampolines are increasingly being incorporated into different games. For example, basketball hoops are often positioned adjacent to a trampoline to enable a user to shoot baskets while bouncing on the trampoline.

One common concern associated with trampolines is the potential risk that an unexperienced user may accidentally bounce off of the trampoline and land on the ground or an adjacent object. Furthermore, it is also possible that a novice user may miss the trampoline bed and land on or between the springs or on the surrounding frame. Conventional trampolines also provide no boundaries when using the trampoline in conjunction with various balls or other toys. For example, if a basket is missed when shooting for a hoop, the ball will often deflect out of the trampoline area.

In one attempt to solve some of the above problems, enclosure systems have been provided wherein poles are vertically mounted around the outer perimeter of the frame so as to encircle the trampoline. Netting is then extended between each of the poles so as to encircle the trampoline bed. As a result, the netting prevents an individual, ball, or other toy from accidentally bouncing off of the trampoline bed and onto the ground.

Although conventional enclosure systems are useful, such systems still have several shortcomings. For example, since the netting is directly mounted on the vertical poles, the poles pose a risk in that an individual can accidentally bounce from the trampoline bed into one of the poles. Furthermore, since the netting is mounted directly to the poles which are positioned around the exterior of the frame, the netting does not preclude an individual from accidentally landing on the springs or surrounding frame. The netting also does not preclude an individual from falling between the springs.

OBJECTS AND BRIEF SUMMARY OF THE INVENTION

Accordingly, it is an object of the present invention to provide an improved enclosure assembly for use with trampolines.

Another object of the present invention is to provide improved trampoline enclosure assemblies as above wherein the netting or other enclosing material is spaced apart from the vertical poles so as to minimize unwanted accidentally contact therewith.

Another object of the present invention is to provide trampoline enclosure assemblies as above wherein the enclosing material is positioned and secured so as to minimize unwanted accidentally contact with the springs and surrounding frame and to prevent falling between the springs.

To achieve the foregoing objects, and in accordance with the invention as embodied and broadly described herein, a trampoline system is provided which includes a trampoline and an enclosure assembly. The trampoline includes a frame comprising a border rail encircling an opening and a plurality of support legs downwardly projecting from the border rail. A trampoline bed is disposed within the opening and is secured to the border rail by a plurality of springs. The trampoline bed has a perimeter edge that is inwardly spaced apart from the border rail.

The enclosure assembly includes a plurality of poles each upwardly projecting from the frame at spaced apart locations around the border rail. Each pole is secured to a corresponding leg of the frame by a pair of clamps so that each pole is supported off the ground surface. One or more tubular cushion encircles each of the poles.

A flexible enclosure wall, such as a sheet of netting material, vertically upwardly extends above the trampoline so as to encircle the trampoline bed at the perimeter edge thereof. A plurality of elongated elastomeric ties extend from each pole to the enclosure wall so as to tightly support the enclosure wall in the vertical orientation. In this position, the enclosure wall is spaced apart from each of the poles at a length substantially equal to the length of the ties. In one embodiment, the ties have a continuous loop configuration with a clip mounted thereon. During assembly, each tie is looped over a corresponding pole and clipped to a ring or other loop fastened on the enclosure wall. To prevent select ties from sliding down the pole, select ties are positioned on top of corresponding tubular cushions surrounding the poles.

One of the unique features of the enclosure assembly is that as a result of the enclosure wall being spaced apart from each pole, even if an individual bounces against the enclosure wall in alignment with a pole, the tightly drawn enclosure wall helps to prevent or at least minimize any impact between the user and the pole. Furthermore, in the embodiment where the ties are made of an elastomeric material, when an individual falls or outwardly pushes against the enclosure wall, each of the ties remote from the individual are resiliently extended. As a result, the extended ties produce an inward resilient force on the enclosure wall that both slows the outward progression of the individual and pushes the individual back towards the center of the trampoline. In this regard, the enclosure assembly operates similar to the surrounding ropes in a boxing ring.

The bottom edge of the enclosure wall is positioned so as to vertically upwardly project from the perimeter edge of the trampoline bed. As such, the enclosure wall functions as a boundary that prevents or minimizes contact with the springs and surrounding frame. To prevent sliding between the bottom edge of the enclosure wall and the trampoline bed, the bottom edge of the enclosure wall is secured at the perimeter edge of the trampoline bed. In one embodiment, this is accomplished by stitching, using a long needle and line, the bottom edge of the enclosure wall with the spring assembly secured to the perimeter edge of the trampoline bed.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
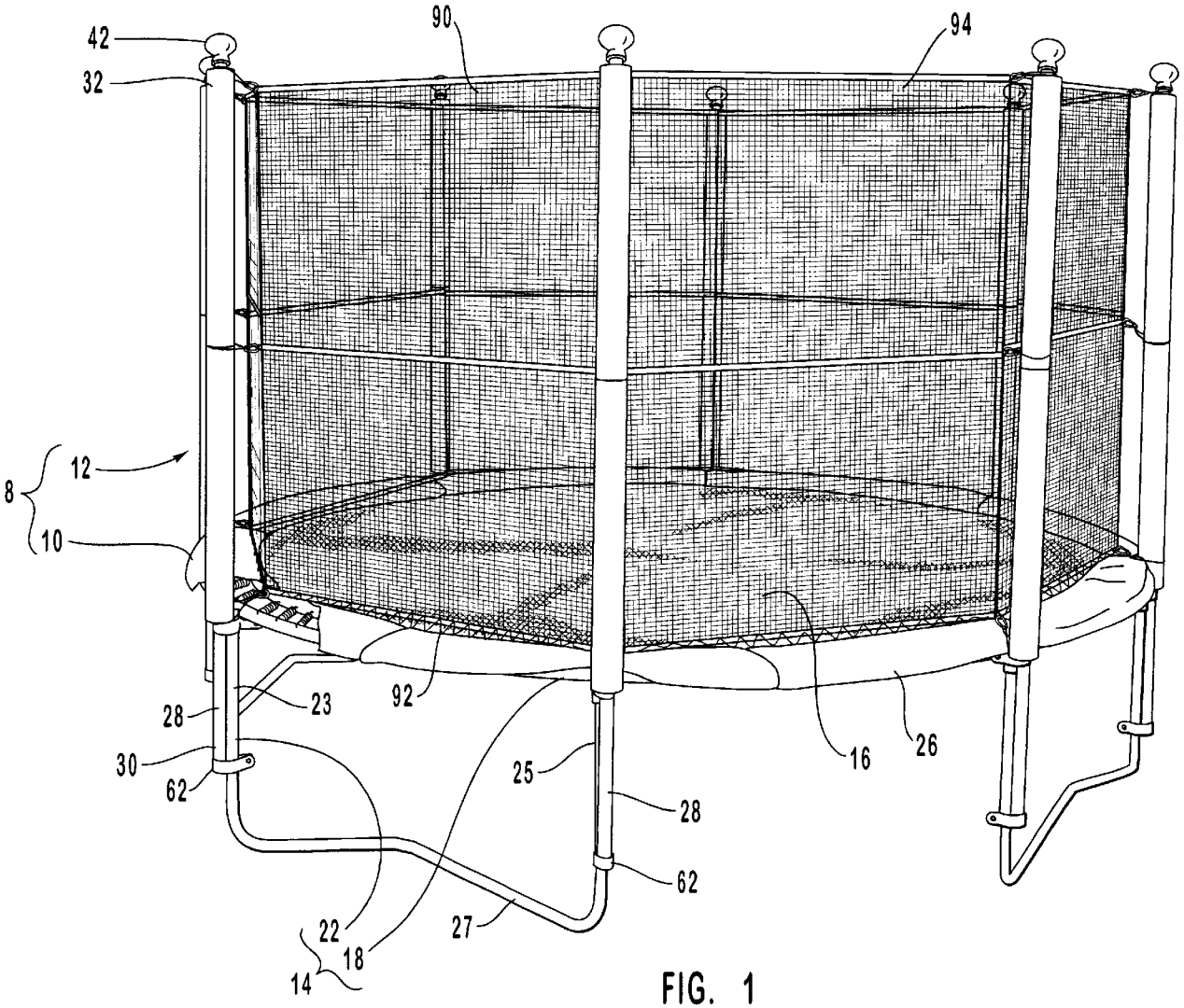
FIG. 1 is a perspective view of a trampoline having an enclosure assembly mounted thereon.
Figure 2:
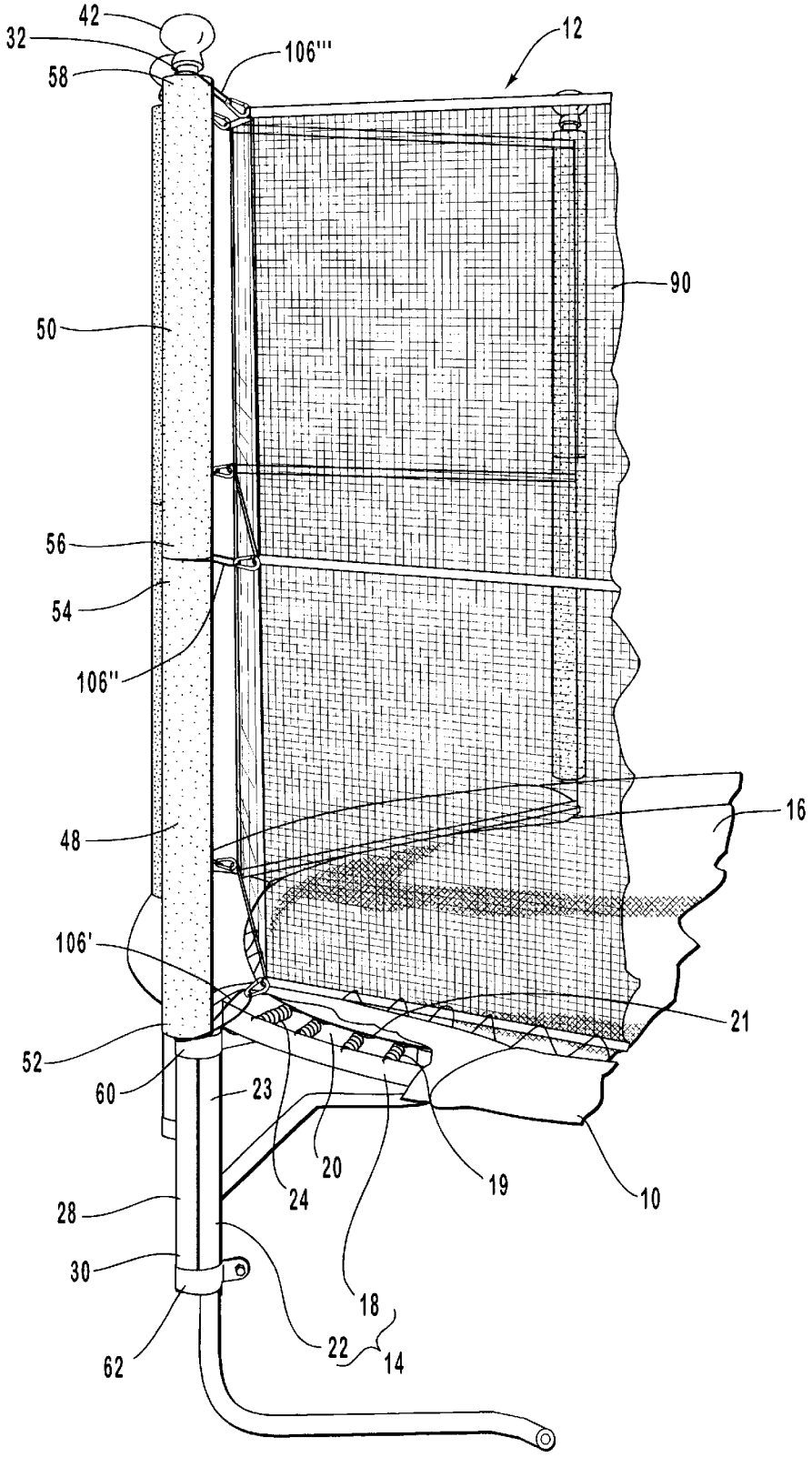
FIG. 2 is a perspective view of a vertical pole connected to an enclosure wall of the system depicted in FIG. 1.

Depicted in FIG. 1 is one embodiment of a trampoline system 8 including a trampoline 10 having an enclosure assembly 12 removably mounted thereon. As depicted in FIG. 2, trampoline 10 comprises a frame 14 which encircles a flexible bed 16. More specifically, frame 14 comprises a border rail 18 which encircles an opening 20. Downwardly projecting from border rail 18 are a plurality of spaced apart legs 22. Each leg 22 comprises a pair of spaced apart vertical shafts 23 and 25 and an upwardly curved cross member 27 extending therebetween. In alternative embodiments, it is envisioned that legs 22 can have a variety of different configurations. For example, each leg 22 can comprise a vertical shaft having a flared foot that rests on the ground surface. Furthermore, if used, cross member 27 can have a variety of different configurations.

Bed 16 is disposed within opening 20 of border rail 18 and extends to a perimeter edge 21. A spring assembly 19 includes a plurality of springs 24. Springs 24 extend between perimeter edge 21 of bed 16 and border rail 18. As such, perimeter edge 21 is spaced apart from border rail 18. As depicted in FIG. 1, cushions 26 are positioned so as to cover border rail 18 and at least a portion of springs 24. In one embodiment, cushions 26 can extend to bed 16. Although trampoline 10 is depicted as having a substantially circular configuration, in alternative embodiments, it is envisioned that border rail 18 and corresponding bed 16 can be square, rectangular, polygonal, or any other desired configuration.

Figure 3:
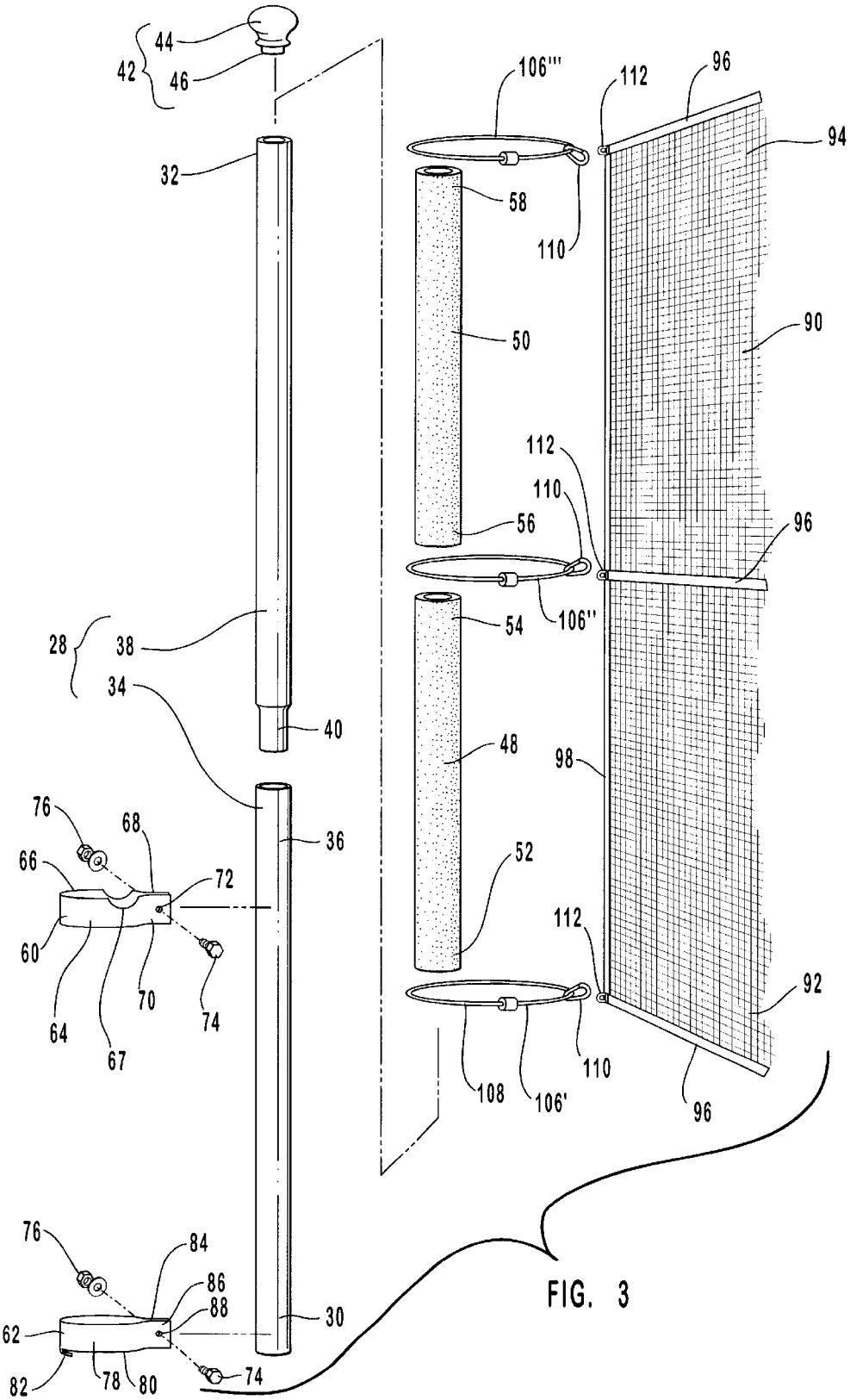
FIG. 3 is a perspective view of the embodiment depicted in FIG. 2 in a disassembled condition.

As also depicted in FIGS. 1 and 2, enclosure assembly 12 includes a plurality of poles 28 mounted on frame 14 at spaced apart locations around border rail 18. Each pole 28 extends from a bottom end 30 to an opposing top end 32. As depicted in FIG. 3, each pole 28 comprises a tubular lower pole portion 34 which extends from bottom end 30 to an opposing end 36 and an upper pole portion 38 that extends from an end 40 to top end 32. End 40 is crimped, beveled, or otherwise constricted such that it can be selectively received within end 36 of lower pole portion 34, thereby selectively coupling pole portions 34 and 38 together. This select assembly of pole 28 enables easy packaging and transport of enclosure assembly 12. In alternative embodiments, each pole 28 can comprise a unitary elongated pole or can comprise three of more pole portions which are selectively coupled together.

Positioned at top end 32 of each pole 28 is a bumper 42. Bumper 42 includes an enlarged head 44 comprised of a foam or other soft pliable material having a stem 46 projecting therefrom. Stem 46 is configured to be received within top end 32 of pole 28 so as to couple the two together. Bumper 42 acts as a cushion to prevent any damage should a user land on or against top end 32 of pole 28. The present invention also envisions that bumper 42 can have a variety of different configurations and can be attached to pole 28 in a variety of different ways.

The present invention also includes means for securing the each pole 28 to frame 14. By way of example and not by limitation, depicted in FIGS. 2 and 3, an upper clamp 60 and a lower clamp 62 secure each pole 28 to a corresponding leg 22. Upper clamp 60 comprises a substantially U-shaped strap 64, preferably made of metal. Strap 64 has a top edge 66 with aligned grooves 67 formed thereon. Strap 64 extends to adjacently disposed opposing ends 68 and 70. An aperture 72 extends through each end 68 and 70. Aperture 72 is configured to receive a bolt 74 which threadedly engages a nut 76. During attachment, strap 64 is wrapped around both pole 28 and leg 22 so that border rail 18 is received within grooves 67. In this position, bolt 74 and nut 76 are tightened so as to securely clamp pole 28 and leg 22 together. Positioning border rail 18 within grooves 67 helps to minimized movement of upper clamp 66 and transfers a portion of any lateral load on pole 28 to border rail 18.

Lower clamp 62 comprises a substantially U-shaped strap 78, preferably made of metal. Strap 78 has a bottom edge 80 having a tab 82 inwardly projecting therefrom. Strap 78 extends to adjacently disposed opposing ends 84 and 86. An aperture 88 extends through each end 84 and 86. Aperture 88 is also configured to receive bolt 74 which threadedly engages nut 76. During attachment, strap 78 is wrapped around both pole 28 and leg 22 so that bottom end 30 of pole 28 rests on tab 82. In this position, bolt 74 and nut 76 are tightened so as to securely clamp pole 28 and leg 22 together. By resting bottom end 30 of pole 28 on tab 82 rather than the ground surface, trampoline 10 remains easily movable. Nevertheless, in alternative embodiments, it is envisioned that poles 28 can rest on the ground surface and that a variety of different ties, bolts, collars, clamps and other conventional structures can be used to secure each of poles 28 to corresponding legs 22.

Positioned around each pole 28 are a pair of tubular cushions 48 and 50. Cushions 48 and 50 are made of a foam or other soft pliable material. Cushion 48 longitudinally extends between a first end 52 and an opposing second end 54. Cushion 50 extends between a first end 56 and an opposing second end 58. Cushions 48 and 50 can be slid onto pole 28 from top end 33. Alternatively, cushions 48 and 50 can have slits along the length thereof so as to enable cushions 48 and 50 to be wrapped around pole 28.

Depicted in FIG. 1, enclosure assembly 12 further includes a flexible enclosure wall 90 extending from a bottom edge 92 to an opposing top edge 94. In one embodiment, enclosure wall 90 is made from a mesh or netting material having openings therein in a range between 4 $mm^2$ to about 36 $mm^2$ with about 8 $mm^2$ to about 20 $mm^2$ being more preferred. In alternative embodiments, enclosure wall 90 can be made from plastic sheets, canvas, or any other flexible sheet-like material.

Figure 5:
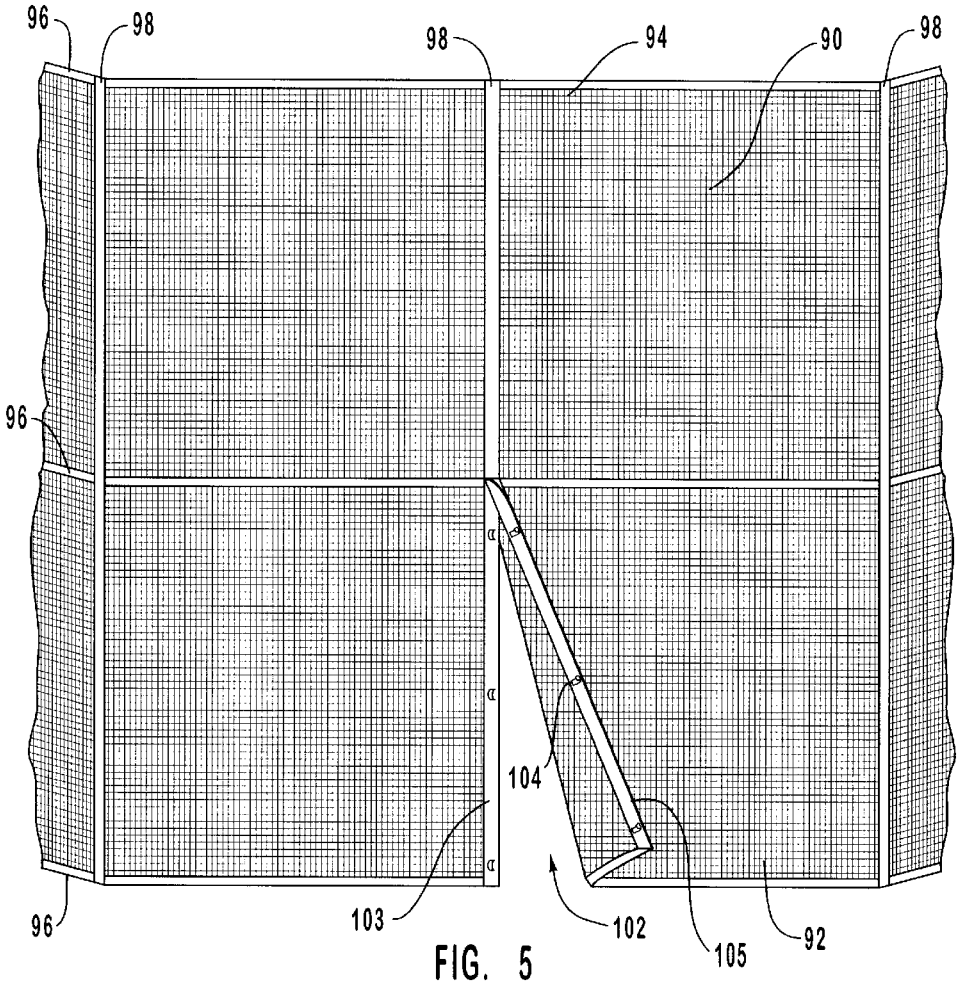
FIG. 5 is a front perspective view of a door opening in the enclosure wall.

As depicted in FIG. 5, a horizontal reinforcing strip 96 is secured along bottom edge 92, top edge 94, and centrally between top and bottom edges 92 and 94 of enclosure wall 90. A plurality of vertical reinforcing strips 98 longitudinally extend between bottom edge 92 and top edge 94 of enclosure wall 90 so as to be in substantial alignment with each of poles 28. In one embodiment, reinforcing strips 96 and 98 are secured on both the interior and exterior surface of enclosure wall 90. As depicted in FIG. 3, mounted at the intersections of horizontal reinforcing strips 96 and vertical reinforcing strips 98 is a loop 112. Each loop 112 can comprise a ring, such as a D-ring, or can be formed from cloth or other material secured to the intersecting reinforcing strips so as to form a loop. The reinforcing strips provide structural strength to the mesh or netting material and assist in securing loops 112 to enclosure wall 90.

In one embodiment, enclosure wall 90 is formed as a continuous loop. In an alternative embodiment, the opposing ends of enclosure wall can be secured together, such as by hooks, zipper, Velcro, or any other conventional means. Depicted in FIG. 5, a door 102 is formed through enclosure wall 90. Hooks 104 are used to secure the opposing sides 103 and 105 of door 102 together. As previously discussed with the ends of enclosure wall 90, other conventional means can also be used to secure the opposing sides of door 102 together.

Enclosure wall 90 is secured to each pole 28 by a plurality of elongated ties 106. As depicted in FIG. 3, a plurality of elongated ties 106', 106", and 106'", extend between a discrete pole 28 and enclosure wall 90. In one embodiment, each tie 106 comprises a continuous elongated loop 108 made from an elastomeric material, such as a bungee cord or elastic band. In alternative embodiments, loop 108 can be made from a nonelastic material such as cord, webbing or cable. Secured to loop 108 is a clip 110.

During assembly, tie 106' is looped around pole 28 and positioned so as to rest between border rail 18 and first end 52 of cushion 48. Tie 106" is looped over pole 28 and supported between second end 54 of cushion 48 and first end 56 of cushion 50. Loop 106" is prevented from sliding down pole 28 by resting on top of second end 54 of cushion 48. Finally, tie 106'" is positioned on top of second end 58 of cushion 50. In this position, each clip 110 is clipped to a corresponding loop 112 on enclosure wall 90. A similar assembly is used to secure enclosure wall 90 to each of poles 28.

Enclosure wall 90 is configured such that when secured by ties 106 to each of poles 28, enclosure wall 90 is tightly suspended in a vertical orientation. Bottom edge 92 of enclosure wall 90 is disposed adjacent to perimeter edge 21 of bed 16. As a result of ties 106 being elongated, enclosure wall 90 is spaced apart from each pole 28 along the length of each pole 28. In one embodiment, the distance between pole 28 and enclosure wall 90 is substantially uniform along the length of each pole 28 and is typically in a range between about 8 cm to about 30 cm with about 12 cm to about 20 cm being more preferred.

One of the unique features of enclosure assembly 28 is that as a result of enclosure wall 90 being spaced apart from each pole 28, even if an individual bounces against enclosure wall 90 in alignment with a pole 28, the tightly drawn enclosure wall 90 helps to prevent or at least minimize any impact between the user and pole 28. Furthermore, in the embodiment where ties 106 are made of an elastomeric material, when an individual falls or outwardly pushes against enclosure wall 90, each of ties 106 remote from the individual are resiliently extended. As a result, the extended ties 106 produce an inward resilient force on enclosure wall 90 that both slows the outward progression of the individual and pushes the individual back towards bed 16.

Figure 4:
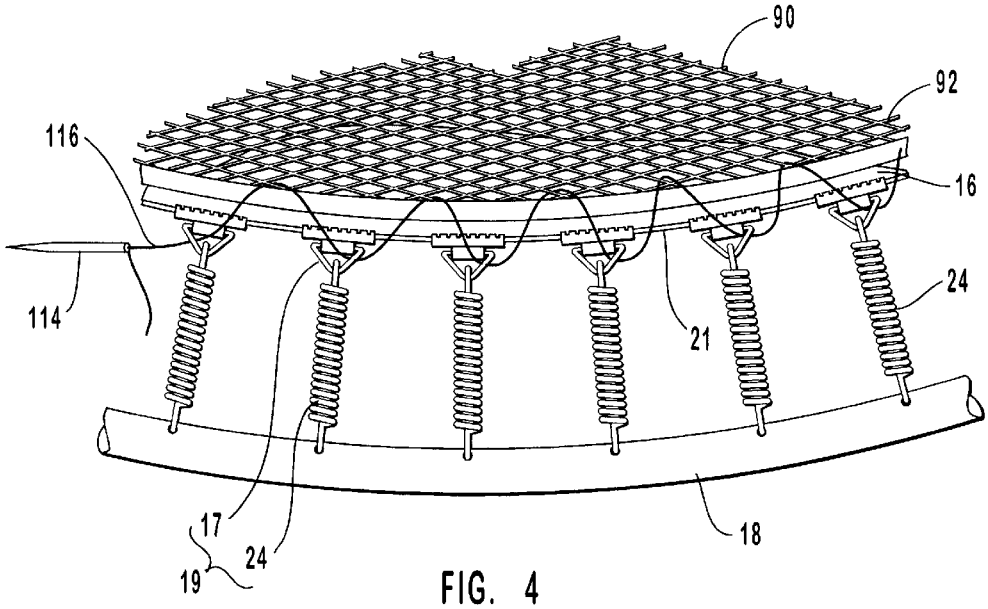
FIG. 4 is a top perspective view showing the attachment of the bottom edge of the enclosure wall to the perimeter edge of the trampoline bed.

Depicted in FIG. 4, to prevent an individual from trying to exit or accidentally slipping between bottom edge 92 of enclosure wall 90 and bed 16, bottom edge 92 is secured at perimeter edge 21 of bed 16. By way of example and not by limitation, spring assembly 19 includes a plurality of V-rings 17 mounted on perimeter edge 21 of bed 16. A large needle 114 is used to manually stitch a line 116, such as plastic line or cord, between bottom edge 92 of enclosure wall 90 and each V-ring 17. The stitching is preferably small enough such that an individual cannot place their head between enclosure wall 92 and bed 16. In alternative embodiments, bottom edge 92 can be secured adjacent to or on perimeter edge 21 by using hooks, clips, stitching, or other conventional fastening techniques. An additional benefit of securing bottom edge 92 of enclosure wall 90 at perimeter edge 21 of bed 16 is that enclosure wall 92 prevents or at least minimizes falling between or against springs 24 or against border rail 18.

The present invention also envisions numerous alternative embodiments that can be incorporated into the inventive enclosure assembly 12. By way of example and not by limitation, ties 106 need not be in the configuration of a loop but can simply be a linear cord, either elastic or rigid, that is connected in any number of conventional means, such as hooks, clips, pins, or bolts, to both pole 28 and enclosure wall 90. Furthermore, although the drawings depict the use of three ties 106 for each pole 28, it is envisions that two, four, or more ties 106 can be used with each pole 28. In this regard, cushions 48 and 50 can also comprise a singe cushion or three or more cushions.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. A trampoline system comprising:

a frame encircling a trampoline bed, the trampoline bed having a perimeter edge inwardly spaced apart from the frame;

a plurality of poles each upwardly projecting from the frame at spaced apart locations around the frame;

upper cushion and a separate lower cushion each at least partially encircling a select pole chosen from the plurality of poles such that the upper cushion and lower cushion are in substantially axial alignment along the length of the select pole;

a flexible enclosure wall vertically upwardly extending around at least a portion of the trampoline bed; and a plurality of elongated ties extending from corresponding poles to the enclosure wall so as to support the enclosure wall at a spaced apart location from each of the poles, a select tie chosen from the plurality of ties being looped around the select pole between the upper cushion and the lower cushion such that the select tie is biased directly against the select pole and is supported between the upper cushion and the lower cushion without radially inwardly compressing on the upper cushion or lower cushion.

2. A trampoline system as recited in claim 1, wherein at least one of the plurality of elongated ties is comprised of an elastomeric material.

3. A trampoline system as recited in claim 1, wherein the enclosure wall has a bottom edge positioned adjacent to and along the perimeter edge of the trampoline bed, the enclosure wall also having an opposing top edge vertically spaced apart from the bottom edge, the top edge bounding an opening thorough which the trampoline bed is openly exposed to the exterior.

4. A trampoline system as recited in claim 3, wherein the bottom edge of the enclosure wall is secured at the perimeter edge of the trampoline bed.

5. A trampoline system as recited in claim 1, wherein the enclosure wall is comprised of a layer of netting.

6. A trampoline system as recited in claim 1, wherein the enclosure wall is substantially uniformly spaced apart from the select pole chosen from the plurality of poles along the length of the select pole in a range between about 8 cm to about 30 cm.

7. A trampoline system as recited in claim 1, wherein the select tie chosen from the plurality of elongated ties has the configuration of a continuous loop.

8. A trampoline system comprising:

(a) a frame comprising a border rail encircling an opening and a plurality of support legs projecting from the border rail at spaced apart locations;

(b) a trampoline bed disposed within the opening and secured to the border rail, the trampoline bed having a perimeter edge inwardly spaced apart from the border rail;

(c) a plurality of poles each upwardly projecting from the frame at spaced apart locations around the frame;

(d) a top clamp having a top edge with a groove formed thereon, the top clamp securing a select pole chosen from the plurality of poles to a corresponding leg such that the border rail of the frame is received within the groove on the top edge of the top clamp;

(e) a flexible enclosure wall vertically upwardly extending above the trampoline bed so as to encircle the trampoline bed; and (f) an tie extending from each pole to the enclosure wall so as to support the enclosure wall.

9. A trampoline system as recited in claim 8, wherein the select pole has a bottom end, the select pole being secured to the frame such that the bottom end of the select pole is supported off the ground surface on which the frame rests.

10. A trampoline system as recited in claim 9, further comprising a lower clamp having an inwardly projecting tab, each bottom clamp securing a select pole to the corresponding leg such that the bottom end of the select pole rests on the tab.

11. A trampoline system as recited in claim 8, wherein at least one of the ties are comprised of an elastomeric material.

12. A trampoline system as recited in claim 8, wherein the enclosure wall is substantially uniformly spaced apart from each of the poles along the length of each of the poles at a distance greater than about 12 cm.

13. A trampoline system as recited in claim 1, wherein the upper cushion terminates at an upper end face, a select second tie chosen from the plurality of ties being looped around the select pole above the upper cushion such that the select second tie is biased directly against the pole and is support on top of the upper end face of the upper cushion.

14. A trampoline system comprising:

a frame encircling a trampoline bed, the trampoline bed having a perimeter edge inwardly spaced apart from the frame;

a plurality of poles each upwardly projecting from the frame at spaced apart locations around the frame;

a cushion at least partially encircling a select pole chosen from the plurality of poles, the cushion terminating at an upper end face;

a flexible enclosure wall vertically upwardly extending around at least a portion of the trampoline bed; and a plurality of elongated ties extending from corresponding poles to the enclosure wall so as to support the enclosure wall at a spaced apart location from each of the poles, a select tie chosen from the plurality of ties being looped around the select pole above the upper end face of the cushion such that the select tie is biased against the select pole and is supported by the upper end face of the cushion, the select tie extending to the select pole without encircling and radially inwardly compressing the cushion.

15. A trampoline system as recited in claim 14, wherein the cushion comprises an upper cushion portion terminating at the upper end face and a lower cushion portion, the upper cushion portion and the lower cushion portion being disposed in substantially axial alignment, a select second tie chosen from the plurality of ties being looped around the select pole between the upper cushion portion and the lower cushion portion such that the select second tie is biased directly against the select pole and is supported between upper cushion portion and the lower cushion portion.

16. A trampoline system as recited in claim 14, further comprising a reinforcing strip fixedly secured to the enclosure wall in alignment with the select pole, the select tie extending from the select pole to the reinforcing strip.

17. A trampoline system as recited in claim 14, wherein the enclosure wall has a bottom edge positioned adjacent to and along the perimeter edge of the trampoline bed, the enclosure wall also having an opposing top edge vertically spaced apart from the bottom edge, the top edge bounding an opening through which the trampoline bed is openly exposed to the exterior.

18. A trampoline system as recited in claim 17, wherein the bottom edge of the enclosure wall is secured at the perimeter edge of the trampoline bed.

19. A trampoline system as recited in claim 14, wherein the enclosure wall is comprised of a layer of netting.

* * * * *

UNITED STATES PATENT AND TRADEMARK OFFICE

CERTIFICATE OF CORRECTION

PATENT NO. : 6,607,468 B1
DATED : August 19, 2003
INVENTOR(S) : Albert G. Nichols, Jr. et al.

It is certified that error appears in the above-identified patent and that said Letters Patent is hereby corrected as shown below:

Title page,
Item [56], References Cited, U.S. PATENT DOCUMENTS, change “Ball Pits” to -- BALL PITS --

Column 1,
Lines 60 and 65, change “accidentally” to -- accidental --

Column 2,
Line 16, change “cushion” to -- cushions --
Line 16, change “encircles” to -- encircle --

Column 4,
Line 26, change “minimized” to -- minimize --

Column 6,
Line 27, change “envisions” to -- envisioned --
Line 29, change “singe” to -- single --
Line 48, before “upper” insert -- an --
Line 59, change “the” to -- a --

Column 7,
Line 3, change “thorough” to -- through --
Line 40, change “an” to -- a --

Column 8,
Line 6, change “support” to -- supported --

Signed and Sealed this

Thirteenth Day of July, 2004

JON W. DUDAS
*Acting Director of the United States Patent and Trademark Office*